United States Patent [19]

Gerber

[11] 4,453,477

[45] Jun. 12, 1984

[54] THREAD CONSUMING MACHINE WITH THREAD COLORING DEVICE AND RELATED PROCESS

[75] Inventor: Heinz J. Gerber, West Hartford, Conn.

[73] Assignee: Gerber Scientific, Inc., South Windsor, Conn.

[21] Appl. No.: 327,622

[22] Filed: Dec. 4, 1981

[51] Int. Cl.[3] ..... D05B 21/00

[52] U.S. Cl. ..... 112/121.12; 112/79 A; 112/266.1; 68/9

[58] Field of Search ..... 112/2, 79 A, 262.1, 112/103, 262.3, 121.12, 266.1, 270, 266.2, 79 R, 79 FF; 68/9, 13, 205 R; 8/479

[56] References Cited

U.S. PATENT DOCUMENTS

| | | | |
|---|---|---|---|
| 2,310,764 | 2/1943 | Denhof | 68/9 |
| 2,910,026 | 10/1959 | Ajovelo | 112/270 |
| 4,106,416 | 8/1978 | Blackstone, Jr. et al. | 112/79 A |

*Primary Examiner*—Peter P. Nerbun

*Attorney, Agent, or Firm*—McCormick, Paulding & Huber

[57] ABSTRACT

A sewing machine, or similar machine which consumes thread at a work station, has combined with it a thread color device located between the work station and a thread supply. The color device causes the thread issuing from it to have any one of a number of available colors, allowing stitches of different color to be made at the work station without changing the thread or rethreading the needle. The timing of a change in thread color at the color device with respect to the schedule of work performed at the work station, and the movement of the thread from the color device to the work station, are controlled so that a change in thread color occurs at the work station at substantially the same time as such change is desired in the work schedule performed at that station. This control may include a means for pulling thread from the work station, a means for performing a thread wasting routine at the work station, or a means for effecting a color change at the color device in advance of the need for such change at the work station with the timing of the color change at the color device being such that the color change arrives at the work station at the desired time in the work schedule.

19 Claims, 8 Drawing Figures

THREAD CONSUMING MACHINE WITH THREAD COLORING DEVICE AND RELATED PROCESS

BACKGROUND OF THE INVENTION

This invention relates to machines such as sewing machines, tufting machines, knitting machines and weaving machines wherein a thread is consumed at a work station, and deals more particularly with such a machine having combined with it a means for selectively varying the color of a thread used by the machine and for causing a change in thread color to arrive at the work station at a desired time in the work schedule. The invention also concerns a related process for operating a thread consuming machine in combination with a thread color varying device.

The invention is illustrated and described herein in connection with a sewing machine in which application it is advantageously used for doing embroidery or other decorative stitching on workpieces, such as leather shoe parts or fabric clothing parts, requiring a number of different thread colors. In such case the sewing machine, a thread color device, a workpiece moving mechanism and other components of the overall system may all be under computer control so that an entire schedule of work, including one or more changes of thread color, is performed automatically without operator intervention, but such complete automation is not necessary and instead movement of the workpiece relative to the work station and other functions and operations in the work schedule may be performed manually. Although the invention has considerable utility when used in conjunction with a sewing machine, it should be understood that in its broader aspects the invention is not limited to a sewing machine and is equally applicable to a tufting machine, a knitting machine, a weaving machine or any other machine consuming thread at a work station and performing a schedule of work at the work station which desirably includes one or more changes in thread color.

The general idea of combining a thread color device with a thread consuming machine is known from prior U.S. Pat. Nos. 2,310,764; 2,712,297; and 3,620,662. In each of these prior patents, however, there is no means or process for coordinating the operation of the color device with the schedule of work performed at the work station, or of controlling the movement of the thread from the color device to the work station, to cause a color change to occur at the work station at a desired time in the work schedule.

The general object of the invention is therefore to provide an improved combination of a thread consuming machine and a thread color varying device which combination is capable of performing a schedule of work at a work station without need for rethreading the machine to make thread color changes and wherein such thread color changes are made by changing the color of a single supply thread before it reaches the work station.

A further object of the invention is to provide a combination of the foregoing character, and a related process, wherein the operation of the thread color device is coordinated with the schedule of work performed at the work station and with the movement of the thread from the color device to the work station so that a change in thread color arrives at the work station at a desired time in the work schedule.

A still further object of the invention is to provide a thread consuming machine of the foregoing character, and a related process, whereby an entire schedule of work may be automatically performed at the work station without operator intervention.

A further object of the invention is to provide a thread consuming machine and related process of the foregoing character whereby sections of thread containing transitions from one color to another are stitched on waste portions of the workpiece or otherwise dealt with so as not to appear as blemishes in the finished product.

Other objects and advantages of the invention will be apparent from the following detailed description of the preferred embodiments of the invention.

SUMMARY OF THE INVENTION

The invention resides in a machine, such as a sewing machine, which consumes thread at a work station, combined with a color device causing thread issuing from a color station remote from the work station to have a selected one of a plurality of different possible colors and a means for causing a change in thread color effected by the color device to arrive at the work station at a desired time in the schedule of work performed at that station.

More particularly the invention resides in the means for causing a color change to arrive at the work station at a desired time including a means for drawing thread from the color station to the work station after a color change is effected at the color station, or including a means anticipating a desired color change at the work station so that a color change is effected at the color station at such time in advance of the need of the color change at the work station that as a result of the normal execution of work and related consumption of thread at the work station the color change will arrive at the work station at the desired time. The means for drawing thread from the color station to the work station may be a separate thread pulling device or a means for executing a thread wasting routine at the work station following the execution of a color change at the color station, and the means for anticipating a desired color change at the work station may include a computerized control device coordinating the operation of the color device with the work performed at the work station in accordance with a stored program of instructions including both instructions for the work performed at the work station and instructions for the color of thread desired during different portions of such work.

The invention still further resides in the color device comprising a turret having a number of angularly spaced open topped wells, carrying liquid dyes or other thread color modifying liquids, any one of which may be moved to a coloring station, and a dipping member engageable with the thread and movable between a first position at which the thread is held out of the well at the coloring station and a second position at which the thread is held in the well at the coloring station so as to pass through the liquid in the well for modification in its color. Following this dipping the thread may pass through other treatment zones at which other liquid, heat or gas is applied to it to further treat and dry it before reaching the work station.

The invention also resides in a related process for operating a thread consuming machine and an associated color device for selectively varying the color of the thread used at the work station and for automatically coordinating the operation of the color device with the operation of the machine so that changes in color of the thread at the work station occur at desired points in the work schedule.

DETAILED DESCRIPTION OF THE PREFERRED EMBODIMENTS

Figure 1:
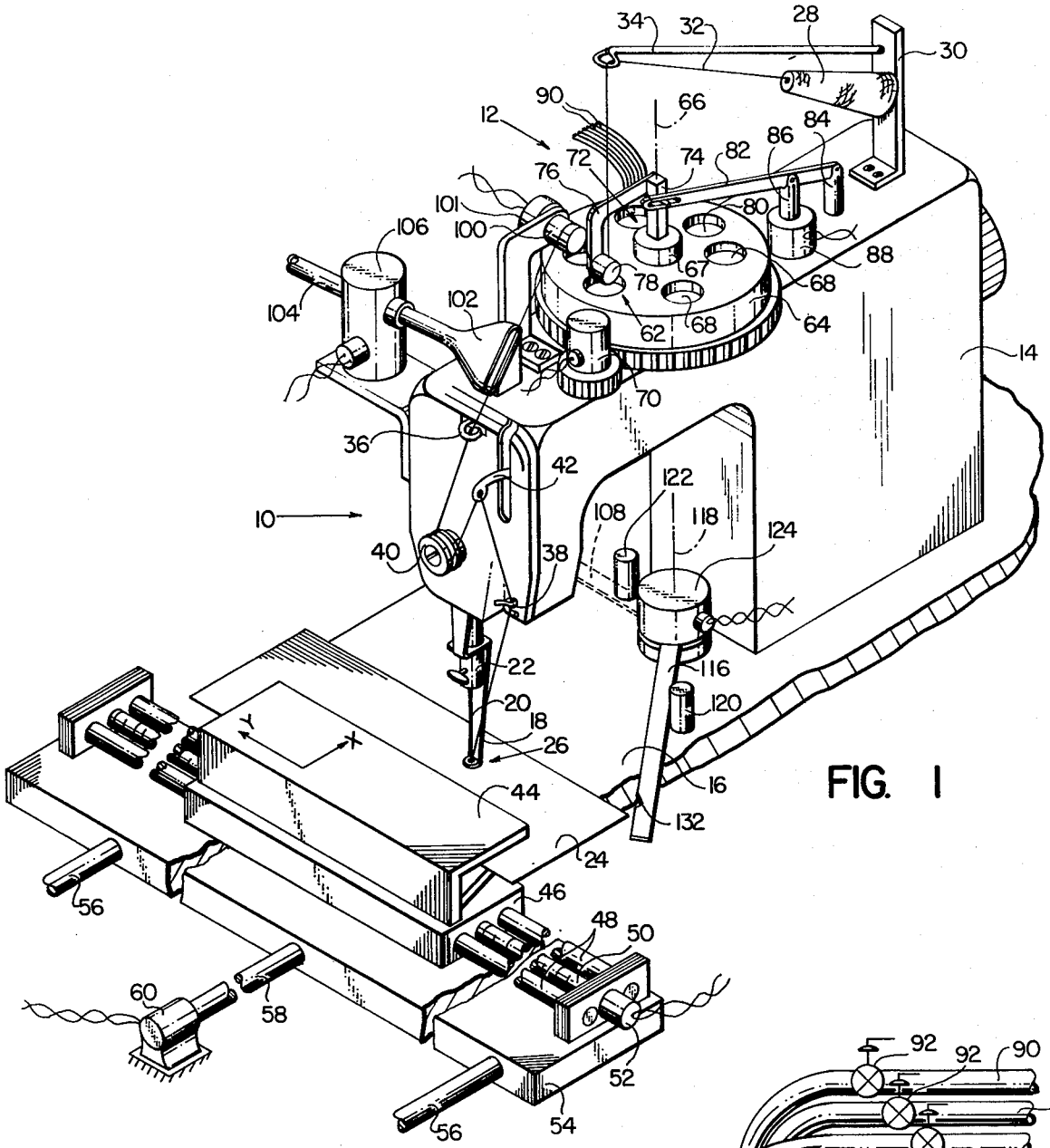
FIG. 1 is a perspective view of a sewing machine and thread color device combination embodying the present invention.
Figure 2:
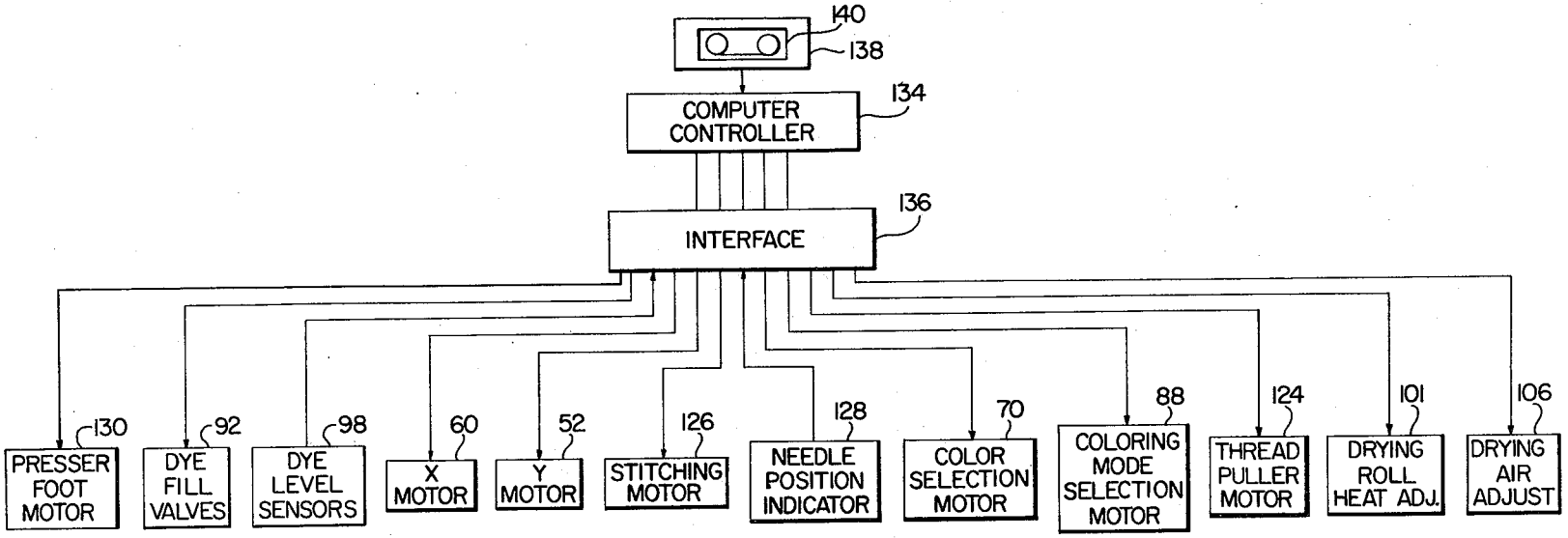
FIG. 2 is a block diagram illustrating generally the control system for the combination of FIG. 1.

FIG. 1 shows the invention embodied in a sewing machine, indicated generally at 10, combined with a thread color device indicated generally at 12. The sewing machine 10 may be any standard type of such machine, for example one for doing decorative stitch work on leather or imitation leather shoe and boot parts or for performing decorative stitch work or embroidery on textile parts. For the present purposes it is sufficient to note that the machine 10 includes a housing 14, a work table 16, a presser foot 18 and a needle 20, carried by a vertically reciprocable needle bar 22, which makes stitches in a workpiece 24 at a sewing or work station indicated generally at 26. A spool of thread 28 is carried by a holder 30 mounted on the top of the housing 14. The thread 32 of the spool is guided from the spool to the needle along a given path, the guide means including a guide rod 34 carried by the holder 30 and two fixed guides 36 and 38 on the left-hand end of the machine as seen in FIG. 1. Between the two guides 36 and 38 is a thread tensioner 40 and a thread take-up lever 42 through both of which the thread 32 also passes. Although not visible in FIG. 1 the machine 10 also includes, as shown in FIG. 2, a stitching motor 126, for reciprocating the needle bar and needle and for driving other parts of the machine as required to make stitches at the work station, a needle position indicator 126, and a motor 130 for raising and lowering the presser foot 18, all of which may be of standard well-known construction.

The sewing machine of the invention may be one wherein workpieces are guided manually past the work station, but also, and as shown in the case of the machine 10, it may be one in which each workpiece 24 is moved automatically relative to the work station. The workpiece moving means may take many different forms and may be any one of a number of well-known commercially available means. By way of illustration such means is shown in FIG. 1 to comprise a work holder or clamp 44 which holds a workpiece 24 during the schedule of work performed on it by the machine. The clamp 44 is movable simultaneously in both of the illustrated X and Y-coordinate directions so that the workpiece may be moved along any desired stitch path relative to the work station 26.

For the illustrated Y-coordinate movement the clamp 44 is supported by a carriage 46 supported for movement in the Y-coordinate direction by two guide rods 48, 48 and driven in such direction by a lead screw 50 rotated by an associated Y-motor 52. For the movement of the clamp in the X-coordinate direction the Y guide rods 48, 48, lead screw 50 and motor 52 are mounted on another carriage 54 supported for movement in the X-coordinate direction by two stationary guide rods 56, 56 and driven in such coordinate direction by a lead screw 58 rotated by an associated X-motor 60. The X and Y motors 52 and 60 are controlled by an associated controller, as shown in FIG. 2, to cause movement of the workpiece along a desired path.

The thread 32 in its path of movement from the spool 28 to the needle 20 passes the color device 12 having a coloring station indicated generally at 62. The color device may be operated to allow the thread to pass the color station 62 in an unmodified state or may be operated to cause it to take on a selected one of a number of possible colors different from the color of the unmodified thread. For example, the thread 32 as it leaves the spool 28 may be of white color and the color device 12 may be operable to dye the thread any one of a number of other different colors so that the thread leaving the color station 62 may selectively be either white or any one of the other different colors.

The illustrated color device 12 includes a turret 64 supported on the top of the housing 14 for rotation about a vertical axis 66, on an axle 67 fixed to the housing 14, and having six open-topped liquid wells 68, 68 equally radially spaced from, and equally angularly spaced about, the axis 66. Therefore, by rotation of the turret 64, accomplished by a color selection motor 70 shown in FIG. 2, any selected one of the wells 68, 68 may be brought to the coloring station 62 or to a filling station 72.

A dipping means for holding the thread 32 either in or out of the well 68 at the coloring station consists of a post 74, vertically reciprocable in the axle 67, having an arm 76 carrying a thread engaging roller 78. In FIG. 1 the post 74 is shown in its raised position at which the thread 32 is held out of the coloring station well, and from this position it is movable downwardly to the point at which the roller 78 enters the coloring station well and holds the thread 32 passing over it submerged in the dye or other color modifying liquid 80 contained in the well. The means for moving the post 74, and its associated arm 76 and dipping roller 78, between its raised and lowered positions may take various different forms. As shown in FIG. 1 it consists of a lever 82 pivotally connected to a stationary post 84 at its right-hand end, pivotally connected to the post 74 with a slot and pin connection at its left-hand end, and intermediate its ends connected to the vertically reciprocable operating rod 86 of a coloring mode selection solenoid 88.

Figure 3:
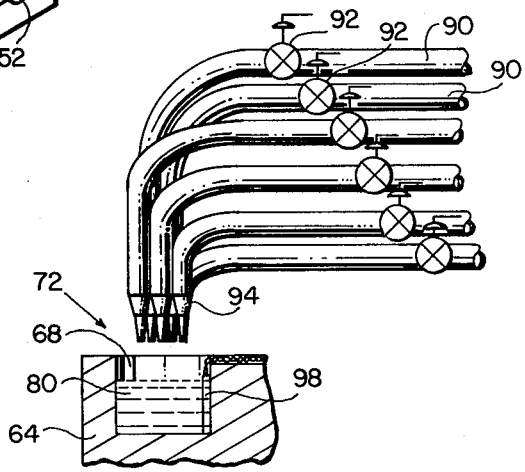
FIG. 3 is a fragmentary view partly in vertical section and partly in elevation showing the fill station of the color device of FIG. 1.

The liquid 80 in the wells 68, 68 may be manually replenished as needed or, as shown, an automatic filling means may be provided. As shown in FIG. 3 such means, at the filling station 72, includes a plurality of liquid supply lines 90, 90, one for each well 68, each connected with its own associated supply (not shown) of liquid. In each line is an actuator controlled valve 92 beyond which the line has an outlet portion 94 positioned to direct fluid passing through it to the well 68 positioned at the filling station. Inside each well is a liquid level sensor 98 electrically connected to the associated controller shown in FIG. 2. When the level of the liquid 80 in any well 68 falls below a predetermined level such low level is sensed by the associated sensor 98 producing a low level signal transmitted to the controller. In response to this signal the controller, after stopping normal operation of the sewing machine 10 and raising the dipping roller 78 to its elevated position, rotates the turret 64, by means of the motor 70, to bring the depleted well 68 to the filling station 72. The valve 92 for that well is then opened by the controller allowing liquid from the associated supply to flow from the associated supply line 90 into the well. When the level reaches the desired filled position such level is detected by the associated element 98 transmitting a signal to the controller acted upon by the controller to close the valve 92 and to return the turret 64, dipping roll 78 and the machine 10 to normal operation.

After passing the color station 62 the thread 32 may be treated in various other different ways before reaching the work station 26. For example, in the embodiment of FIG. 1 the thread after leaving the dipping roll 78 passes over a heated member or roll 100, having an associated temperature control 101 whereby its temperature may be adjusted in response to a signal from the controller shown in FIG. 2, which heats the thread to assist in drying or setting the liquid applied at the coloring station. Beyond the heated member 100 the thread passes a gas treatment station at which a current of air or other gas is applied to the thread by a nozzle 102 to further dry or set the liquid applied to the thread at the coloring station. If desired, this air or other gas may be applied at an elevated temperature. It is supplied by a supply line 104 from a suitable source (not shown) and its rate of discharge from the nozzle 102 is controlled by an electrically actuated control valve 106.

Figure 4:
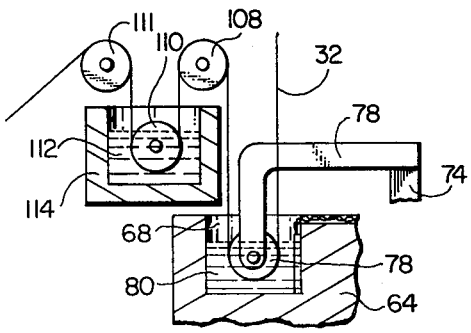
FIG. 4 is a fragmentary vertical sectional view taken through the dipping station of a color device similar to that of FIG. 1 but including a secondary dipping means.

In addition to, or instead of, the post-dipping treatment stations represented by the heater 100 and the nozzle 102, post-dipping treatment may include one or more stations at which additional liquids are applied to the thread. For example, in FIG. 4 the thread 32 is shown, after leaving the dipping roll 78, to pass over three guide rolls 108, 110 and 111 which guide it through a second body of liquid 112 contained in a reservoir 114. This liquid 112, for example, may be a catalyst or setting agent which reacts with the liquid 80 applied to the thread at the dipping station to better set or finish the coloring effect of that liquid. After leaving the roll 111 the thread 32 may pass through other post-dipping treatment stations such as that of the heated roll 100 and gas nozzle 102 of FIG. 1.

From FIG. 1 and the foregoing discussion it will be noted that the coloring station 62 is located some distance along the thread path from the work station 26 of the needle 20. Preferably the components of the color device 12 are arranged on the machine 10 so that this distance is minimized but in all cases it will necessarily amount to some substantial length. Therefore, if the stitching performed at the work station reaches a point in the work schedule at which a new color of thread is needed and then the color device 12 is then operated to provide such new thread color the length of thread existing between the work station and the color device will, at that moment, be of the wrong color. To avoid this problem the invention provides a means and process for coordinating the operation of the sewing machine 10, the color device 12, and of the movement of the thread along its path to bring a thread color change to the work station at exactly the time such color change is desired in the work schedule.

In the illustrated case of FIG. 1 the means for coordinating the operation of the sewing machine 10, of the color device 12 and of the thread movement includes a thread puller in the form of an angularly oscillating arm 116 which oscillates about a vertical axis 118 between two limits defined by stops 120 and 122, such motion being effected by a thread pulling motor 124. The operation of the thread puller in cooperation with the other components of the combination is as follows. The sewing machine 10 is operated, with the stitching motor 126 energized, to perform work at the work station 26, that is to make stitches in the workpiece 24, until reaching a point in the work schedule at which a new color of thread is desired at the work station. The normal work schedule is then interrupted and the needle 20, by combined operation of the stitching motor 126 and needle position indicator 128, is moved to a raised position. The presser foot 18 is also raised by its motor 130 and, as is customary, this raising of the presser foot also operates the thread tensioner 40 to release its grip on the thread 32 thereby allowing the thread to be freely pulled through it. Sometime during or after this procedure the color device 12 is operated as previously described to stop supplying the previous thread color and to cause the thread issuing therefrom to thereafter have the newly desired color. The thread puller is then operated to swing its arm 116 from the illustrated full line position of FIG. 1 to the illustrated broken line position of the same figure. In the course of this movement the arm engages the thread at the work station, by a notch 132 in the arm, and carries it away from the work station, thereby pulling a length of thread along its path from the color device 12 toward the work station 26. The length of the arm 116 and the extent of its angular movement is such that the length of thread pulled toward the work station is approximately equal to or greater than the length of the thread path between the color station and the work station, thereby causing thread of the new color to appear at work station. The arm 116 is then returned to its starting position by the motor 124, the presser foot 18 is again lowered, thereby resetting the thread tensioner 40 to regrip the thread passing therethrough, and the needle 20 is set in motion by the stitching motor 126 to resume the work schedule performed at the work station. The excess thread pulled by the thread puller can thereafter be cut from the workpiece 24. If desired the work schedule performed at the work station may include some tacking stitches ending the stitching of the old color and some tacking stitches beginning the stitching of the new color to tightly finish the stitching of one color and to tightly begin the stitching of the next color.

The means for controlling the components shown in FIG. 1 may vary widely and an example of one such control means is shown in FIG. 2 to include a computer controller 134 with an associated interface 136 for automatically controlling all of the operations required in the performance of a full schedule of work on a workpiece, including thread color changes at one or more points in such work schedule. The computer controller is one having an associated memory storing a set of instructions prescribing the work to be performed at the work station and the associated thread color changes to be made at desired points in such work schedule. Preferably, and as shown such memory includes a tape reader 138 and an associated tape cassette 140, or other replaceable record, on which the instructions for a particular workpiece are stored, thereby allowing the controller to be used with different workpieces by merely substituting different cassettes 140 for different workpieces.

The controller 134 operates on instructions read from the tape of the cassette 140, and supplied to it by the reader 138, and on other information supplied to it by the interface 136 from the dye level sensors 98 and the needle position indicator 128; and, if desired, from other sensors sensing other conditions of the operation performed by the components of FIG. 1.

The instructions stored by the cassette 140 are ordered in sequence and are executed in such sequence by the controller 134. They include machine instructions dictating operation of the sewing machine 10 and of its associated work holding clamp 44, including its X and Y drive motors 60 and 52, to cause normal stitching of the associated workpiece 24 along desired lines. The instructions also include color instructions dictating the color of thread to be used for each stitch. The machine instructions may provide a separate instruction for each stitch or each instruction may dictate a series of stitches, as for example by defining end point coordinates and the degree of curvature between end points. The color instructions may be arranged so that a color instruction accompanies each machine instruction dictating the color of thread to be used during the execution of such machine instruction, in which case a change in thread color is signaled by a change in color instruction when shifting from one color instruction to the next. Alternatively, the thread color instructions may consist of thread color change instructions which are arranged to occur at points in the list of machine instructions at which thread color changes are desired at the work station. That is, when a thread color change instruction appears it dictates a new thread color which persists during the execution of subsequent machine instructions until a new thread color change instruction is reached. In either event, whenever a thread color change signal is detected by the computer controller 134 while executing machine instructions a change in thread color is executed by operating the color device 12 and other components of FIG. 1 in the manner previously described.

Figure 5:
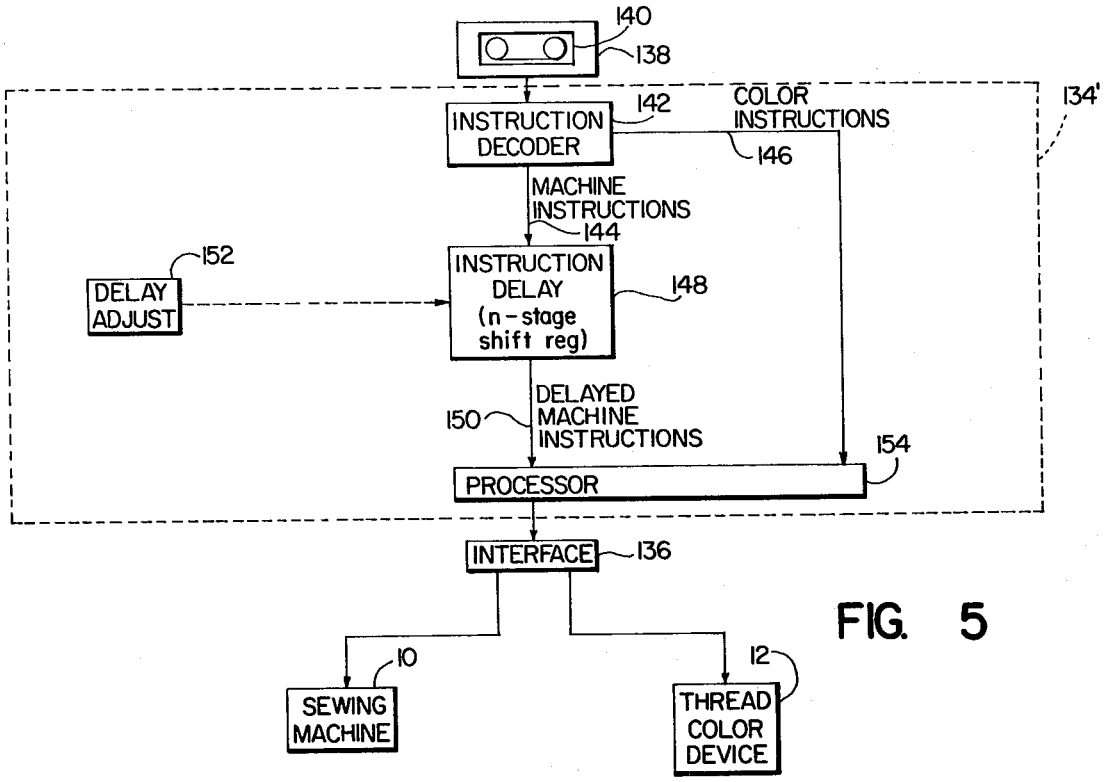
FIG. 5 is a block diagram illustrating the construction of a computer controller similar to that of FIG. 2 but comprising another embodiment of the invention.

Instead of using a thread puller, a sewing machine-color device combination otherwise similar to that of FIG. 1 may have an associated controller which achieves the desired appearance of thread color changes at the work station at desired times in the work schedule by operating the thread color device 12 in anticipation of desired changes in thread color at the work station 26 so that when thread color changes are desired at the work station such thread color changes appear as a result of normal operation of the machine, and normal consumption of thread at the work station, without having to execute any separate thread pulling routine. FIG. 5 shows a controller 134' organized to provide such anticipation when used with a memory cassette 140 or other stored source of instructions in which machine instructions are provided for each stitch.

Referring to FIG. 5, the illustrated controller 134' includes an instruction decoder 142 which receives instructions from the reader 138 and decodes or separates such instructions into machine instructions supplied on the output line 144 and color instructions supplied to the output line 146. That is, each instruction provided by the memory cassette 140 consists of a machine instruction dictating the making of one stitch by the thread consuming machine 10 and another instruction either specifying the color of thread to be used for that stitch or indicating whether a change to a specified new color of thread is to occur at the time of such stitch. The machine instructions appearing on the line 144 are transmitted to an instruction delay 148, such as an n-stage shift register, which functions to provide machine instructions on its output line 150 which are identical to the machine instructions appearing on the input line 144 but which are delayed by a number of computer cycles, where each computer cycle corresponds to one stitch made by the sewing machine 10. The number of computer cycles involved in the delay effected by the instruction delay device 148 may be adjusted by an associated delay adjusting device 152. For example, in the case where the instruction delay device 148 is an n-stage shift register the delay adjusting mechanism 152 operates to adjust its number of active stages. The delay adjusting device 152 in turn may be designed for manual adjustment or it may be operated automatically by the processor 154 in response to changes in stitch length or other operating parameters.

The operation of the controller 134' of FIG. 5 is such that when a new instruction is received by the instruction decoder 142 the color portion of that instruction is sent immediately to the processor 154; and if such color instruction dictates a change in color the color device 12 is immediately operated to effect such a color change. The machine portion of the instruction is in turn sent to the instruction delay device 144 so that this instruction is not sent to the processor 154 for execution until it appears as a delayed machine instruction on the line 150. This appearance does not occur until after the running of the number of computer cycles, and the execution of the corresponding number of stitches at the work station, involved in the instruction delay, as set by the delay adjustment means 152. Therefore, by proper adjustment of the delay involved in the device 148 the delayed version of a machine instruction can be made to reach the processor 154 and to be executed by the processor to cause the production of a stitch by the sewing machine 10 at substantially the same time as the thread color change produced by the thread color device, and dictated by the color instruction originally associated with the machine instruction on the tape of the cassette 140, reaches the work station.

When a change in thread color is made by the illustrated color device 12, or by most any other such device which may be used in practicing the invention, the color change does not occur abruptly, or at a definite point, along the length of the thread 32 but instead occurs along a section of thread of some substantial length. In this transitional section the thread may be dark, blurred, of varying or indefinite color or of some other objectionable coloring, so that it may be desirable to avoid using such section in the normal stitching carried out by the sewing machine at its work station. When a thread puller, such as shown in FIG. 1, is used, this avoidance of sewing with a section of thread in which a color transition occurs can be gained by assuring that the thread puller when operated pulls a sufficient length of thread so that after such operation the transition section is located beyond the needle 20 and the new color of thread at the needle. When no thread puller is used and the color device 12 is instead operated in anticipation of the desire for thread color changes at the work station the avoidance of the color transition sections of thread can be gained by operating the sewing machine so that when a transition section arrives at the needle the machine goes through a thread wasting routine during which the thread is stitched into a waste portion of the workpiece or into some other portion of the workpiece at which the appearance of the thread color transition will not be noticed or objectionable.

Figure 6:
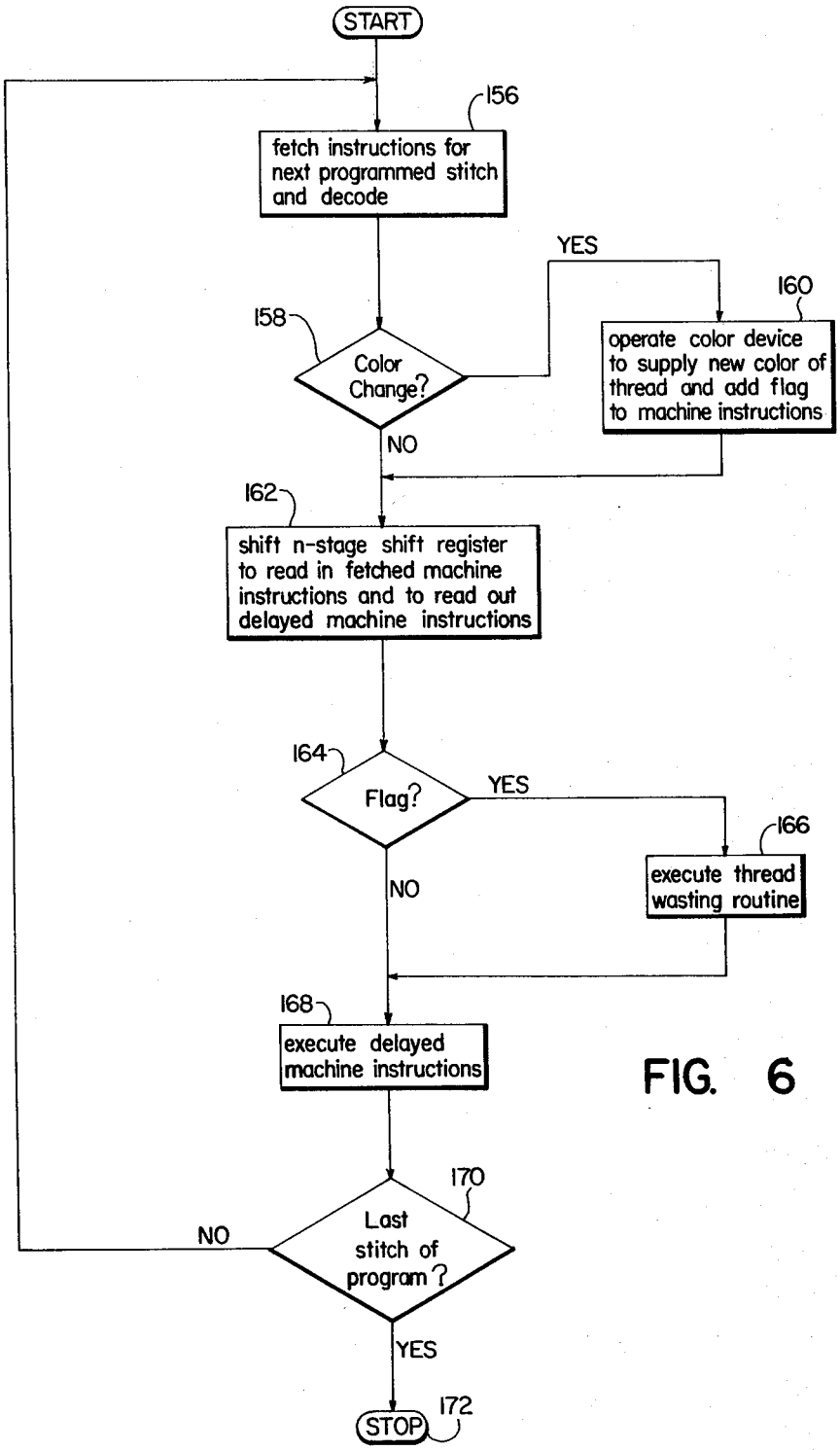
FIG. 6 is a flow chart showing the steps performed by a computer controller in executing instructions stored in an associated memory in accordance with another embodiment of the invention.

FIG. 6 shows a flow diagram showing how a control system such as that of FIG. 5 may be operated to execute thread wasting routines to avoid stitching with sections of color transition thread. Referring to FIG. 6 at the start of a new stitch, as indicated at 156, a set of instructions for the next programmed stitch are fetched from the memory cassette 140 and are decoded into color instructions and machine instructions by the decoder 142. The color instructions are then interrogated, as indicated at 158, to determine whether the color instructions indicate that the next stitch is to be made with thread of a new color or not. If a new color is decided on the color device is operated, as indicated at 160, to supply a new color of thread, a flag is added to the machine instructions, and the machine instructions with the added flag are then supplied to the n-stage shift register, as indicated at 162. If the color change decision made at 158 is that no color change is to be made the machine instructions are added directly to the n-stage shift register without a flag. As a new set of instructions, with or without flag, are entered into the n-stage shift register a delayed set of machine instructions are read from the register. These delayed instructions are interrogated as indicated at 164 to determine whether they include a flag. If a flag is present the sewing machine is operated, as indicated at 166, to execute a thread wasting routine. After this, as indicated at 168, the delayed machine instructions are executed to cause the sewing machine to make a stitch. If the decision at 164 is that no flag is included in the delayed machine instructions, the machine instructions are immediately executed, as indicated at 168. After the stitch is made an interrogation is made, as indicated at 170, of whether such stitch is the last stitch of the program. The information on which this interrogation is based may, for example, be included in the delayed machine instructions themselves. If the stitch is the last stitch of the program the work schedule is stopped, as indicated at 172, otherwise the described routine is repeated for the next stitch.

As described above in connection with FIG. 6 the thread wasting stitch routine carried out to avoid normal stitching with a section of thread containing a color transition involves moving the workpiece to bring the needle to a waste portion of the workpiece, or to some other acceptable portion of the workpiece, making some stitches in such workpiece portion and then returning the workpiece to bring the needle back to its previous position or some other position at which normal stitching is resumed. This wastes thread not only as a result of the stitching carried out at the waste portion of the workpiece but also by the fact that thread is drawn through the needle as the workpiece is moved relative to the needle to bring the needle to the waste stitching portion of the workpiece; and more thread is drawn through the needle as the workpiece is thereafter moved relative to the needle to bring the needle back to the point of the workpiece at which normal stitching is resumed.

Figure 7:
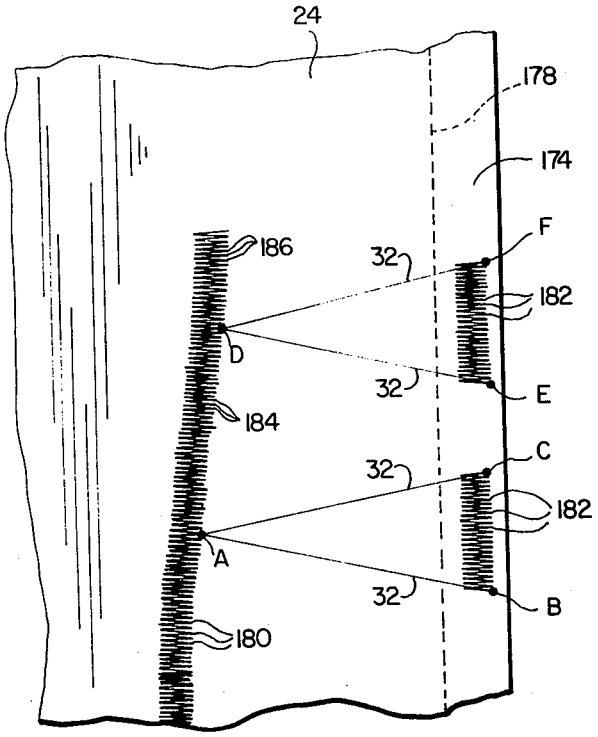
FIG. 7 is a view showing a path of stitching on a workpiece which path includes thread wasting routines.

By way of example, FIG. 7 shows a portion of a workpiece 24 including two sets of stitches made during two different thread wasting routines. In this figure the workpiece 24 includes a waste portion 174 located between its right-hand edge 176 and a line 178 running parallel to that edge, the waste portion 174 being a portion which does not appear in the final product because, for example, the workpiece 24 is later sewn to another workpiece by a line of stitching running along the line 178. The illustrated stitching includes a first series of stitches 180 which are of one color and continue until reaching the point A on the workpiece. At this point a new color of thread is desired and accordingly the thread color device 12 is operated to thereafter supply such new color. After this operation of the thread color device the needle and workpiece are moved relative to one another to bring the needle to the point B of the workpiece and thereafter thread wasting stitches 182 are made in the waste portion 174 until reaching the point C. The workpiece is then moved relative to the needle to bring the needle back to the point A on the workpiece. Then, normal stitching is resumed to make a series of stitches 184 of the new color, it being understood that in moving the needle from the point A to B, in making the waste stitches 182 and in moving the needle from the point C to A sufficient thread is consumed to assure that the new color of thread appears at the needle when stitching is resumed at the point A. The stitches 184 are continued until reaching the point D at which another thread color is desired and then the process previously described is repeated with the coloring device being operated to provide the new color and with the needle being moved to the point D to the point E, with waste stitches 182 being made in the waste portion 174 with the needle being thereafter being returned from the point F to the point D, and with normal stitching then being resumed to make new stitches 186 of a color different from the stitches 184.

In some cases it may not be necessary to make waste stitches in the workpiece and instead it may be sufficient to have a thread wasting routine which consists merely of moving the workpiece relative to the needle to merely draw a length of thread through the needle with the workpiece then being moved to return the needle to a point on the workpiece at which normal stitching is resumed. Of course, in all cases in which the workpiece is moved relative to the needle the needle, through the cooperation of the stitching motor 126 and the needle position indicator 128, is first moved to a raised position and the presser foot is raised, allowing the workpiece to move freely relative to the work station and releasing the thread tensioner 40, the presser foot being returned to its down position and the tensioner thereby to its thread gripping condition, after the workpiece is returned to the point desired for the resumption of normal stitching. Also, in connection with any thread wasting routine either with or without waste stitching into a portion of the workpiece, one or more tacking stitches may be made at the end of normal stitching before the execution of the thread wasting routine and likewise one or more tacking stitches may be made after the execution of the thread wasting routine and before resuming normal stitching, so that a series of stitches of one color is ended by tacking stitches and a series of stitches of a new color are started by tacking stitches.

Figure 8:
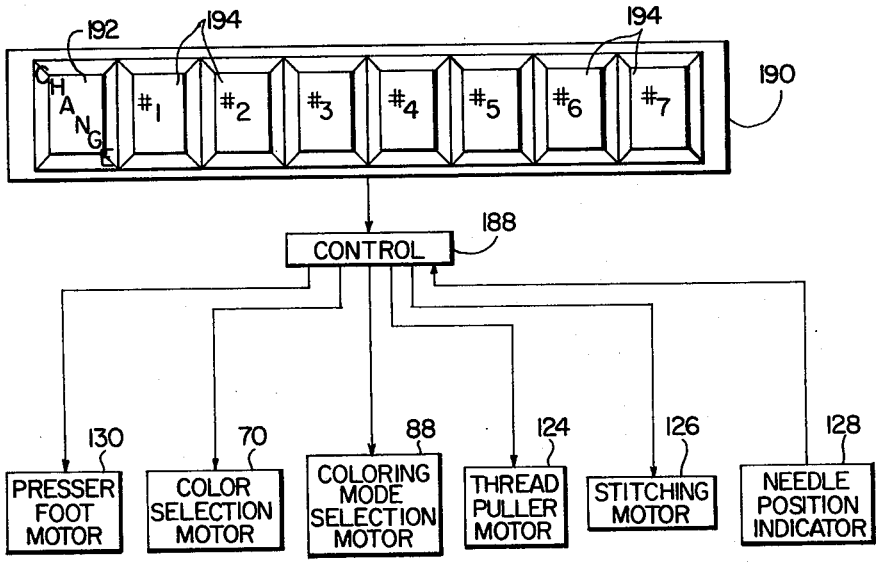
FIG. 8 is a block diagram showing another control system which may be used with the combination of FIG. 1.

Instead of the control for the sewing machine-color device combination being one wherein all or most of the functions of the sewing machine and of the color device are carried out automatically in response to stored instructions, a control system for the combination may be provided wherein color change signals are supplied manually with the control, in response to such manually input signals, operating the sewing machine and the color device to provide a new thread color and to move thread of such new color to the needle before normal stitching is resumed at the work station. One such control, for example, is shown in FIG. 8 at 188 and operates in conjunction with a manual switch panel 190 having a change push button 192 and seven color selection push buttons 194, 194. In this case it is assumed that the workpiece is guided manually past the work station, that the liquid wells 68, 68 of the color device 12 are refilled manually as required and that adjustments in the temperature of the heating member 100 and in the rate of gas flow from the nozzle 102 are made manually if such components are used in the system. Therefore, in using a sewing machine-color device combination in cooperation with the control of FIG. 8 the operator in stitching a workpiece moves the workpiece along a desired stitching path while the sewing machine is in a stitching mode, to make stitches of a given color in the workpiece. When a point in the work schedule is reached at which a new color of thread is desired at the work station the operator pushes the one of the color selection push buttons 194, 194 of the switch panel 190 corresponding to the desired new color, and then pushes the change push button 192 to command a change of color to that dictated by the operated push button 194. In response to these signals the control 188 stops the normal stitching of the sewing machine, if not already stopped by the operator, and operates the stitching motor 126 in cooperation with the needle position indicator 128 to bring the needle to a raised position. The presser foot motor 130 is also operated to raise the presser foot 18 and to release the thread tensioner 140. Before the execution of these operations, or simultaneously with them, the color device 12 is also operated through the color selection motor 70 and the coloring mode selection motor 88 to condition it to supply thread of the new color corresponding to the operated color selection push button 194. The thread puller motor 124 is then next operated to pull a length of thread through the needle to bring the new color of thread to the needle and the presser foot motor 130 is again operated to lower the presser foot and to condition the tensioner 40 to again grip the thread. The stitching motor 126 is then again energized, either by the operator or by the control 188, to resume normal stitching using thread of the new color.

Of course, it will be understood that although the manually operated switch panel 190 has been described for use with a combination in which the workpiece is guided manually past the work station it may also be used with a system wherein a workpiece is moved automatically past the work station by a work holding clamp moved by motors controlled by instructions stored in a memory, such as a tape cassette, and executed by the control 188.

I claim:

1. The combination comprising:

a sewing machine consuming thread at a stitching station at which stitches are made in a workpiece, means for moving said stitching station and a workpiece relative to one another in two coordinate directions to allow said sewing machine to stitch along a two dimensional stitch path, guide means for guiding a thread from a supply thereof along a given path to said stitching station, a color device positioned along said thread path at a color station remote from said stitching station, said color device having color selecting means operable to cause a thread issuing from said color station to have a selected one of a plurality of different possible colors, a computer with a memory means storing instructions dictating a schedule of work to be performed at said stitching station, said computer being responsive to said instructions to control the operation of said sewing machine in making stitches at said stitching station and also to control said means for moving said stitching station and workpiece relative to one another to cause said sewing machine to automatically stitch along a two dimensional stitch path defined by said work schedule instructions, and means for producing a color change signal indicating the desire for a new thread color at a given point in said work schedule performed at said stitching station, said computer also being responsive to said color change signal for both operating said color selection means of said color device to effect a change in the color of the thread issuing therefrom and for causing thread movement along said path so that thread of the new color resulting from said change arrives at said stitching station when the work performed at said stitching station is at said given point in said work schedule.

2. The combination comprising:

a machine consuming thread at a work station, guide means for guiding a thread from a supply thereof along a given path to said work station, a color device positioned along said thread path at a color station remote from said work station, said color device having color selecting means operable to cause a thread issuing from said color station to have a selected one of a plurality of different possible colors, means for producing a color change signal indicating the desire for a new thread color at a given point in the work schedule performed at said work station, and means responsive to said color change signal for both operating said color selection means of said color device to effect a change in the color of the thread issuing therefrom and for causing thread movement along said path so that thread of the new color resulting from said change arrives at said work station when the work performed at said work station is at said given point in said work schedule, said means responsive to said color change signal including means for temporarily stopping the normal schedule of work performed at said work station, means for operating said color selection means of said color device to effect a change in color of the thread issuing therefrom, means operable after said color selection means for drawing thread from said color device toward said work station until thread of the new color resulting from the color change arrives at said work station, and means operable after the operation of said thread drawing means for resuming the normal schedule of work performed at said work station.

3. The combination defined in claim 2 further characterized by:

said thread drawing means being a means for causing work performed at said work station to undergo a thread wasting routine separate from said normal schedule of work.

4. The combination defined in claim 2 further characterized by:

said thread drawing means being a movable member operable to engage said thread at said work station and to pull it away from said work station.

5. The combination defined in any one of claims 2, 3, 4 or 11 further characterized by:

said machine being a sewing machine having a needle at said work station through which needle said thread passes.

6. The combination defined in claim 5 further characterized by:

said sewing machine including a work holder, and means for automatically moving said work holder relative to said work station during the performance of a schedule of work.

7. The combination defined in claim 2 further characterized by:

said color device including a turret located between said supply of thread and the said work station and rotatable about a generally vertical axis, said turret having a plurality of open top liquid carrying wells spaced angularly from one another about said generally vertical axis, a portion of said turret underlying said thread path at a coloring station and said turret being rotatable about said generally vertical axis to bring any one of said wells to said coloring station, and a dipping member at said coloring station engagable with said thread and movable between a first position at which said thread is held out of the well at said coloring station and a second position at which said thread is held in the well at said coloring station so as to pass through the liquid in such well.

8. The combination defined in claim 7 further characterized by:

said color device including a means located between said dipping member and said work station for heating said thread.

9. The combination defined in claim 7 further characterized by:

said color device including a means located between said dipping member and said work station for applying a current of gas to said thread.

10. The combination defined in claim 7 further characterized by:

said color device including a means located between said dipping member and said work station for applying a second liquid to said thread.

11. The combination defined in claim 2 further characterized by:

said means for producing a color change signal being a manually operable device.

12. The combination comprising:

a machine consuming thread at a work station, guide means for guiding a thread from a supply thereof along a give path to said work station, a color device positioned along said thread path at a color station remote from said work station, said color device having color selecting means operable to cause a thread issuing from said color station to have a selected one of a plurality of different possible colors, means for producing a color change signal indicating the desire for a new thread color at a given point in the work schedule performed at said work station, and means responsive to said color change signal for both operating said color selection means of said color device to effect a change in the color of the thread issuing therefrom and for causing thread movement along said path so that thread of the new color resulting from said change arrives at said work station when the work performed at said work station is at said given point in said work schedule, said machine being a sewing machine having a needle at said work station through which needle said thread passes and which needle is movable into and out of a workpiece to stitch said thread to such workpiece, said sewing machine including a work holder for holding a workpiece, and means for automatically moving said work holder relative to said work station during the performance of a schedule of work, and said means responsive to said color change signal including means for temporarily stopping the normal schedule of work performed at said work station and for positioning said needle out of the workpiece carried by said work holder, means for operating said color selection means of said color device to effect a change in color of the thread issuing therefrom, means operable after operation of said color selection means for moving said work holder to draw thread from said color device toward said work station until thread of the new color resulting from the color change arrives at said work station and for thereafter moving said work holder to a work resuming position, and means operable after the return of said work holder to said work resuming position for resuming the normal schedule of work performed at said work station.

13. The combination comprising:

a machine consuming thread at a work station, guide means for guiding a thread from a supply thereof along a given path to said work station, a color device positioned along said thread path at a color station remote from said work station, said color device having color selecting means operable to cause a thread issuing from said color station to have a selected one of a plurality of different possible colors, means for producing a color change signal indicating the desire for a new thread color at a given point in the work schedule performed at said work station, and means responsive to said color change signal for both operating said color selection means of said color device to effect a change in the color of the thread issuing therefrom and for causing thread movement along said path so that thread of the new color resulting from said change arrives at said work station when the work performed at said work station is at said given point in said work schedule, said machine being a sewing machine having a needle at said work station through which needle said thread passes and which needle is movable into and out of a workpiece to stitch said thread to such workpiece, said sewing machine including a work holder for holding a workpiece, and means for automatically moving said work holder relative to said work station during the performance of a schedule of work, and said means responsive to said color change signal including means for temporarily stopping the normal schedule of work performed at said work station, means for operating said color selection means of said color device to effect a change in color of the thread issuing therefrom, means operable after operation of said color selection means for moving said work holder to bring a different portion of the workpeice carried by said work holder to said work station, means for thereafter operating said sewing machine to cause said needle to make stitches in said different portion of said workpiece until thread of the new color resulting from the color change arrives at said needle, means for thereafter moving said work holder to a work resuming position, and means operable after the return of said work holder to said work resuming position for resuming the normal schedule of work performed at said work station.

14. The combination comprising:

a machine consuming thread at a work station, guide means for guiding a thread from a supply thereof along a given path to said work station, a color device positioned along said thread path at a color station remote from said work station, said color device having color selecting means operable to cause a thread issuing from said color station to have a selected one of a plurality of different possible colors, means for producing a color change signal indicating the desire for a new thread color at a given point in the work schedule performed at said work station, and means responsive to said color change signal for both operating said color selection means of said color device to effect a change in the color of the thread issuing therefrom and for causing thread movement along said path so that thread of the new color resulting from said change arrives at said work station when the work performed at said work station is at said given point in said work schedule, said machine being a sewing machine having a needle at said work station through which needle said thread passes, a presser foot at said work station movable between raised and lowered positions, a means for moving said presser foot between said raised and lowered positions, a means for reciprocating said needle, means for sensing the position of said needle, a thread pulling member movable between a first position and a second position and having a path of movement extending through said work station so that in moving from said first position to said second position, while said needle and presser foot are raised, said thread pulling member engages said thread to pull it away from said work station and to thereby draw thread from said color device toward said work station, and a means driving said thread pulling member, a manually operable switch means for producing a color selection signal indicating a desired thread color and for producing said color change signal, and control means responsive to said color selection and color change signals from said manually operable switch means and to said needle position indicator for causing operation of said color selection operating means to effect the desired change in the color of the thread issuing therefrom and for, in sequence, deenergizing said needle reciprocating means with said needle in a raised position, causing said presser foot moving means to move said presser foot to its raised position, causing said thread pulling member to move from said first position to said second position and back to said first position, causing said presser foot moving means to move said presser foot to its lowered position, and energizing said needle reciprocating means to resume stitching at said work station.

15. The combination comprising:

a machine for repetitively performing a thread consuming work step at a work station and which work step is variable during the running of said machine, guide means for guiding a thread from a supply thereof along a given path to said work station, a color device positioned along said thread path at a color station remote from said work station, said color device having color selection means operable to cause a thread issuing from said color station to have a selected one of a plurality of different possible colors, a memory means storing machine instructions dictating a schedule of work steps to be performed at said work station and color instructions dictating the thread color desired at said work station at various points in said work schedule, a reader for reading said machine instructions and said color instructions from said memory, means for executing machine instructions supplied by said reader, means for executing color instructions supplied by said reader, and means for coordinating said machine instruction executing means and said color instruction executing means so that at said work station changes in the color of said thread actually occur at desired times in said work step schedule.

16. The process comprising the steps of:

providing a machine which consumes thread at a work station, a guide means for guiding a thread from a supply thereof along a given path to the work station, and a color device positioned along the thread path at a color station remote from the work station and operable to cause the thread issuing from the color station to have a selected one of a plurality of different possible colors, operating said machine to perform a schedule of work at said work station in the course of which schedule at least one change in the color of said thread desirably occurs at said work station at one point in said work schedule, automatically coordinating the operation of said color device with the operation of said machine so that said thread undergoes said desired change in color at said work station at said one point in said work schedule, and providing a thread pulling means operable to engage thread at said work station and to pull it therefrom to draw thread from said color device to said work station, said step of automatically coordinating the operation of said machine and of said color device including the substeps of operating said color device to effect a change in the color of the thread issuing therefrom, stopping the normal operation of said machine at said work station, operating said thread puller to draw a quantity of thread from said color station toward said work station and thereafter resuming normal operation of said machine at said work station.

17. The process comprising the steps of:

providing a machine which consumes thread at a work station, a guide means for guiding a thread from a supply thereof along a given path to the work station, and a color device positioned along the thread path at a color station remote from the work station and operable to cause the thread issuing from the color station to have a selected one of a plurality of different possible colors, operating said machine to perform a schedule of work at said work station in the course of which schedule at least one change in the color of said thread desirably occurs at said work station at one point in said work schedule, automatically coordinating the operation of said color device with the operation of said machine so that said thread undergoes said desired change in color at said work station at said one point in said work schedule, said thread consuming machine being a sewing machine, said step of automatically coordinating the operation of said machine and of said color device including the substeps of operating said color device to effect a color change in the thread issuing therefrom at a time in advance of the time at which the work performed at said work station reaches said one point in said work schedule, and continuing the performance of work at said work station until reaching said one point in said work schedule, said time at which said color device is operated being such that between such time and the time at which the work performed at said work station reaches said one point in said work schedule the work performed by said machine at said work station consumes a length of thread approximately equal to the length of said thread path between said color device and said work station, and at the time the work performed at said work station reaches said one point in said work schedule executing a thread wasting stitch routine to hide the section of thread containing the color transition resulting from said color change.

18. The process defined in claim 17 further characterized by:

at the time the work performed at said work station reaches said one point in said work schedule shifting the workpiece relative to said work station so that said thread wasting stitch routine is performed on a waste portion of said workpiece.

19. The process comprising the steps of:

providing a machine which consumes thread at a work station, a guide means for guiding a thread from a supply thereof along a given path to the work station, and a color device positioned along the thread path at a color station remote from the work station and operable to cause the thread issuing from the color station to have a selected one of a plurality of different possible colors, operating said machine to perform a schedule of work at said work station in the course of which schedule at least one change in the color of said thread desirably occurs at said work station at one point in said work schedule, automatically coordinating the operation of said color device with the operation of said machine so that said thread undergoes said desired change in color at said work station at said one point in said work schedule, and said thread consuming machine being a sewing machine, said step of coordinating the operation of said machine and of said color device including the substeps of operating said color device to effect a color change in the thread issuing therefrom, stopping the normal operation of said sewing machine at said work station, automatically moving the workpiece away from said work station to draw a quantity of thread from said color station toward said work station, moving said workpiece to a work resuming position relative to said work station, and thereafter resuming normal operation of said machine at said work station.

* * * * *